US012252966B2

(12) United States Patent
Zachariah et al.

(10) Patent No.: US 12,252,966 B2
(45) Date of Patent: Mar. 18, 2025

(54) INFLOW CONTROL DEVICE WITH DISSOLVABLE PLUGS

(71) Applicant: Halliburton Energy Services, Inc., Houston, TX (US)

(72) Inventors: Jacob Zachariah, Houston, TX (US); Bryan Ping Chew Chay, Houston, TX (US); Stephen Michael Greci, Houston, TX (US); Michael Linley Fripp, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/805,363

(22) Filed: Jun. 3, 2022

(65) Prior Publication Data

US 2022/0316302 A1 Oct. 6, 2022

Related U.S. Application Data

(62) Division of application No. 16/470,125, filed as application No. PCT/US2018/044295 on Jul. 30, 2018, now Pat. No. 11,352,862.

(51) Int. Cl.

| | |
|---|---|
| ***E21B 43/12*** | (2006.01) |
| ***E21B 29/02*** | (2006.01) |
| ***E21B 33/12*** | (2006.01) |
| ***E21B 33/13*** | (2006.01) |

(52) U.S. Cl.

CPC ..... *E21B 43/12* (2013.01); *E21B 29/02* (2013.01); *E21B 33/12* (2013.01); *E21B 33/13* (2013.01); *E21B 2200/08* (2020.05)

(58) Field of Classification Search

CPC ..... E21B 43/12; E21B 29/02; E21B 33/12

See application file for complete search history.

(56) References Cited

U.S. PATENT DOCUMENTS

| | | | |
|---|---|---|---|
| 8,499,827 | B2 | 8/2013 | Dusterhoft et al. |
| 8,985,207 | B2 | 3/2015 | Thorkildsen et al. |
| 9,151,143 | B2 | 10/2015 | Holderman et al. |
| 10,358,893 | B2 | 7/2019 | Greci |
| 11,168,541 | B2 | 11/2021 | Scott |

(Continued)

OTHER PUBLICATIONS

International Search Report and Written Opinion of the International Searching Authority, mailed Apr. 26, 2019, PCT/US2018/044295, 11 pages, ISR/KR.

*Primary Examiner* — Catherine Loikith

(74) *Attorney, Agent, or Firm* — Scott Richardson; Parker Justiss, P.C.

(57) ABSTRACT

A lower completion assembly includes a tubular comprising an interior passageway defined by an internal surface of the pipe and a port extending between external and internal surfaces of the tubular. The port is defined by a first surface that extends between the internal and external surfaces. The assembly also includes an inflow control device that is coupled to the external surface of the pipe and that comprises a fluid exit that is adjacent the port. The assembly has a first configuration and a second configuration. When in the first configuration a dissolvable plug extends across the fluid exit to fluidically isolate the fluid exit from the interior passageway and a gap is defined adjacent the first surface. When in the second configuration, the dissolvable plug does not extend across the fluid exit and the fluid exit is in fluid communication with the interior passageway.

2 Claims, 9 Drawing Sheets

(56) References Cited

U.S. PATENT DOCUMENTS

| | | | |
|---|---|---|---|
| 2007/0039741 | A1 | 2/2007 | Hailey, Jr. |
| 2009/0283271 | A1 | 11/2009 | Langeslag |
| 2012/0067574 | A1 | 3/2012 | Lopez |
| 2014/0020898 | A1 | 1/2014 | Holderman et al. |
| 2015/0330191 | A1 | 11/2015 | Holderman |
| 2016/0230509 | A1 | 8/2016 | Lopez et al. |

INFLOW CONTROL DEVICE WITH DISSOLVABLE PLUGS

The present application claims priority to U.S. Non-Provisional application Ser. No. 16/470,125, filed on Jun. 14, 2019, which claims priority to PCT Application No. PCT/US2018/044295, filed Jul. 30, 2018, the benefit of which is claimed and the disclosures of which are incorporated herein by reference in their entirety.

TECHNICAL FIELD

The present disclosure relates generally to a lower completion assembly having an inflow control device ("ICD") alternatively capable of maintaining a minimum pressure within a fluid passageway of the lower completion assembly and placing the ICD in fluid communication with the fluid passageway of the lower completion assembly.

BACKGROUND

In the process of completing an oil or gas well, a tubular is run downhole and used to communicate produced hydrocarbon fluids from the formation to the surface. Often, this tubular is coupled to an ICD that controls unwanted liquids, such as gas and/or water, from entering the tubular and that controls the flow of the fluids into the tubular. Generally, the fluids flow through the ICD into the tubular. However, the ability for fluid flow through the ICD is not desired during some completion operations, and as a result, the use of a wash pipe assembly if often necessary.

DETAILED DESCRIPTION

Figure 1:
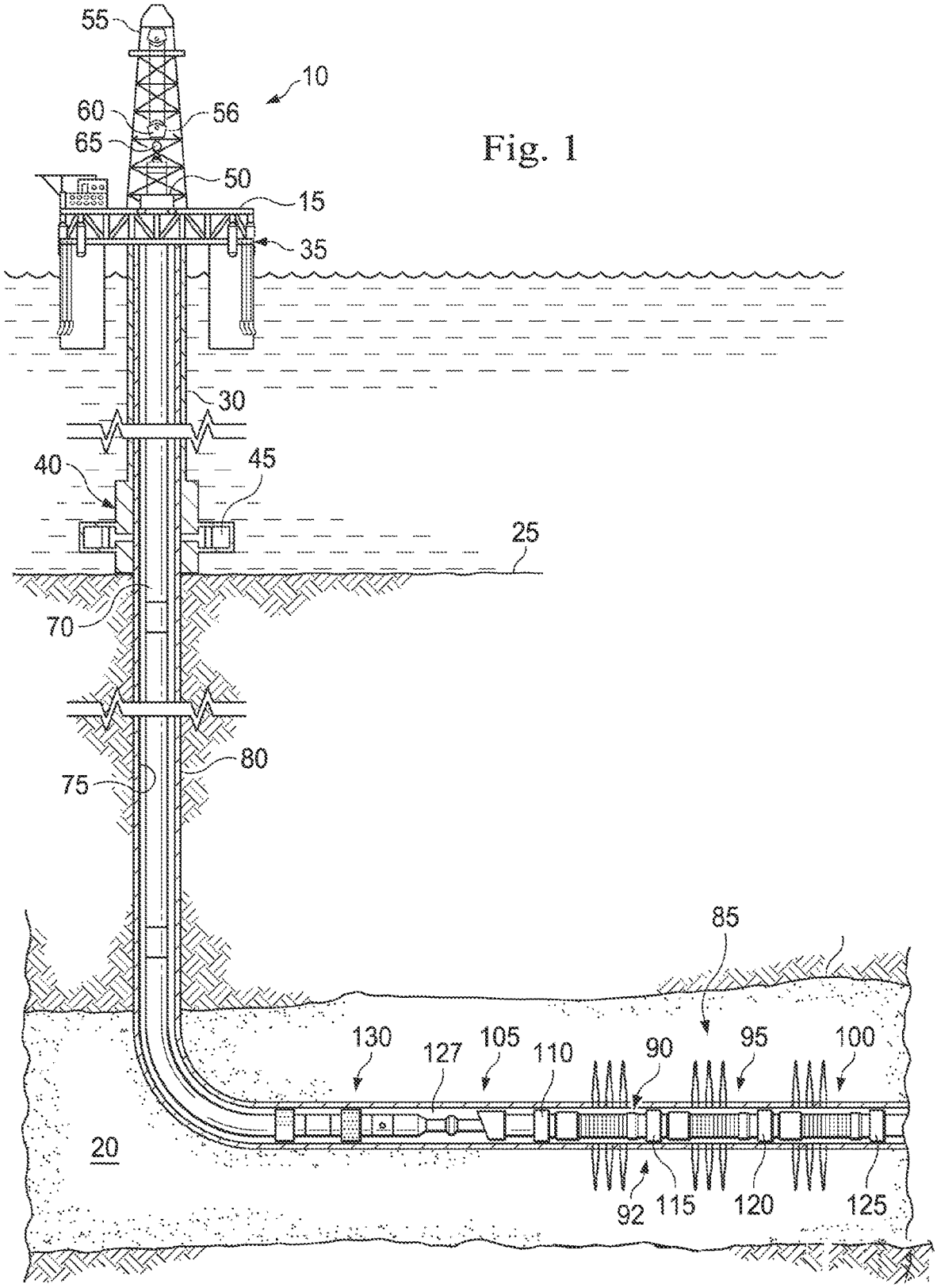
FIG. 1 is a schematic illustration of an offshore oil and gas platform operably coupled to an ICD according to an embodiment of the present disclosure.

Referring initially to FIG. 1, an upper completion assembly is installed in a well having a lower completion assembly disposed therein from an offshore oil or gas platform that is schematically illustrated and generally designated 10. However, and in some cases, a single trip completion assembly (i.e., not having separate upper and lower completion assemblies) are installed in the well. A semi-submersible platform 15 is positioned over a submerged oil and gas formation 20 located below a sea floor 25. A subsea conduit 30 extends from a deck 35 of the platform 15 to a subsea wellhead installation 40, including blowout preventers 45. The platform 15 has a hoisting apparatus 50, a derrick 55, a travel block 56, a hook 60, and a swivel 65 for raising and lowering pipe strings, such as a substantially tubular, axially extending tubing string 70.

A wellbore 75 extends through the various earth strata including the formation 20 and has a casing string 80 cemented therein. Disposed in a substantially horizontal portion of the wellbore 75 is a lower completion assembly 85 that includes at least one inflow control device ("ICD") such as ICD 90, at least one screen assembly, such as screen assembly 92 or screen assembly 95 or screen assembly 100, and may include various other components, such as a latch subassembly 105, a packer 110, a packer 115, a packer 120, and a packer 125. An annulus 127 is defined between an external surface of the lower completion assembly 85 and an internal surface of the wellbore 75 (e.g., the casing 80 for a cased hole and the formation for an open hole).

Disposed in the wellbore 75 is an upper completion assembly 130 that couples to the latch subassembly 105 to place the upper completion assembly 130 and the tubing string 70 in communication with the lower completion assembly 85. In some embodiments, the latch subassembly 105 is omitted.

Even though FIG. 1 depicts a horizontal wellbore, it should be understood by those skilled in the art that the apparatus according to the present disclosure is equally well suited for use in wellbores having other orientations including vertical wellbores, slanted wellbores, uphill wellbores, multilateral wellbores or the like. Accordingly, it should be understood by those skilled in the art that the use of directional terms such as "above," "below," "upper," "lower," "upward," "downward," "uphole," "downhole" and the like are used in relation to the illustrative embodiments as they are depicted in the figures, the upward direction being toward the top of the corresponding figure and the downward direction being toward the bottom of the corresponding figure, the uphole direction being toward the surface of the well, the downhole direction being toward the toe of the well. Also, even though FIG. 1 depicts an offshore operation, it should be understood by those skilled in the art that the apparatus according to the present disclosure is equally well suited for use in onshore operations. Further, even though FIG. 1 depicts a cased hole completion, it should be understood by those skilled in the art that the apparatus according to the present disclosure is equally well suited for use in open hole completions.

Figure 2:
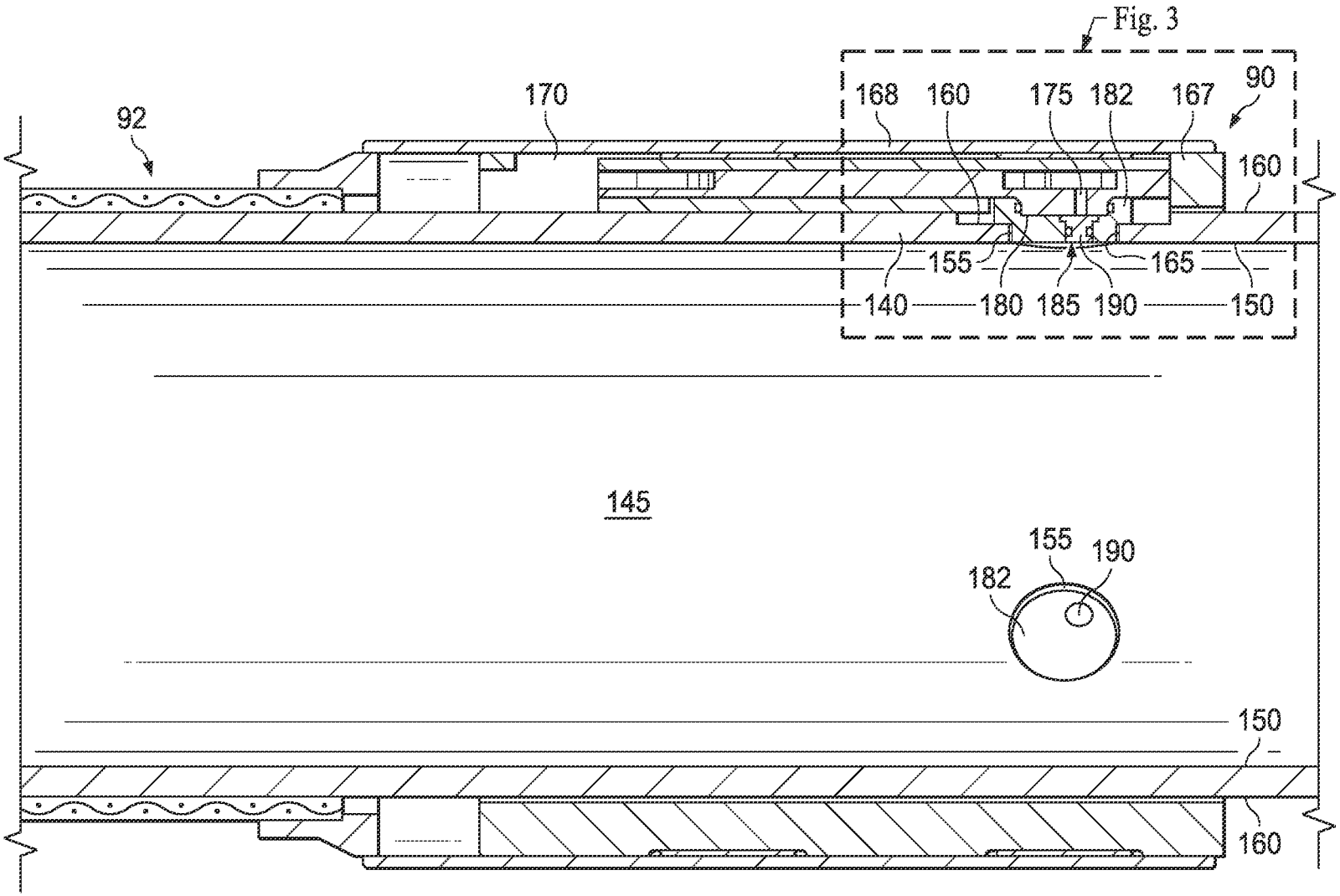
FIG. 2 illustrates a sectional view of the ICD of FIG. 1 in a first configuration, according to an example embodiment of the present disclosure.
Figure 3:
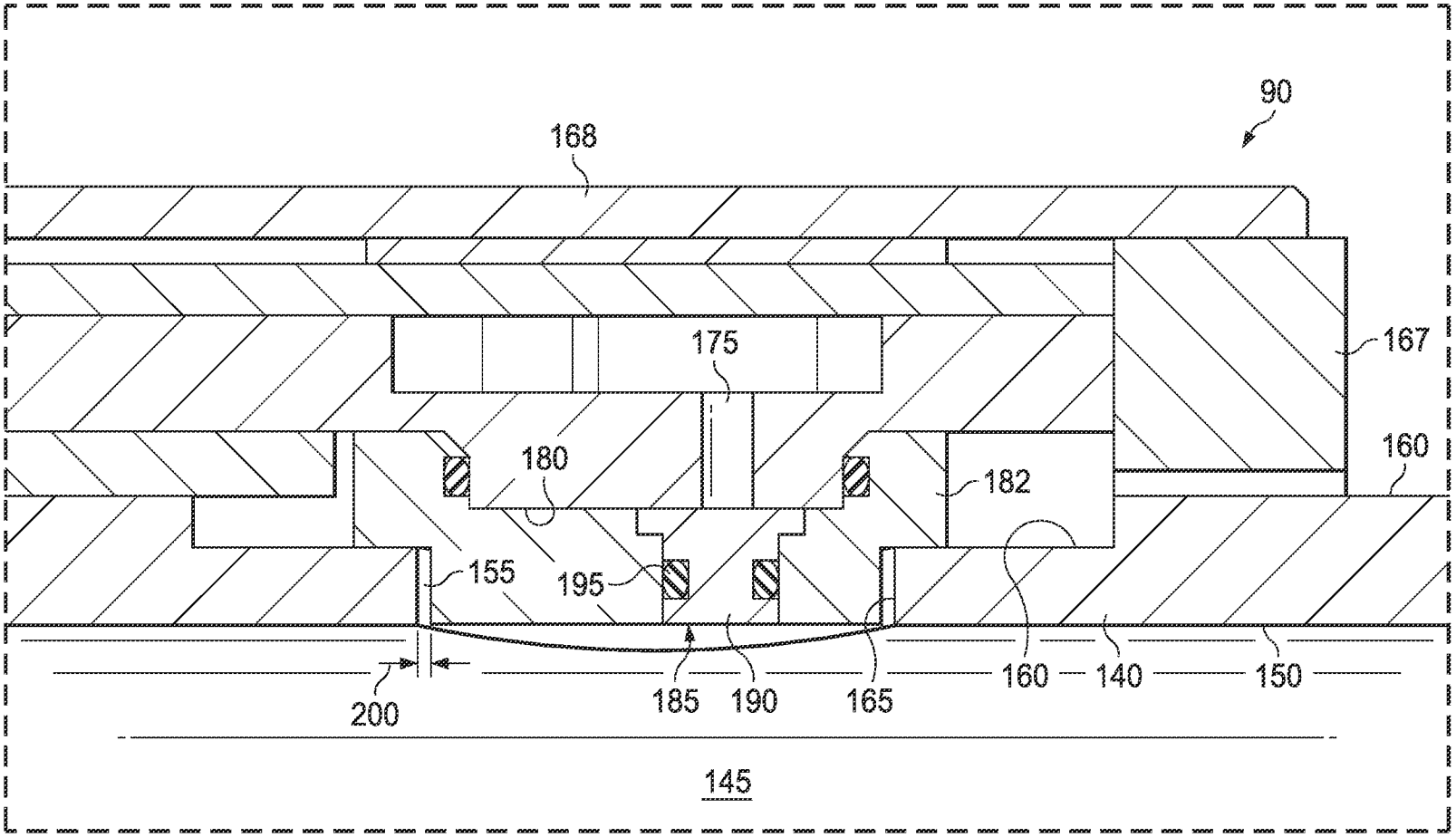
FIG. 3 illustrates an enlarged view of the ICD of FIG. 2 in a first configuration, according to an example embodiment of the present disclosure.

FIG. 2 illustrates a sectional view of the ICD 90 and a tubular 140. FIG. 3 is an enlarged view of an outlet section of the ICD 90 and the tubular 140 of FIG. 2. As illustrated, the ICD 90 is coupled to or forms a portion of the screen assembly 92. However, in other embodiments, the ICD 90 receives downhole fluids directly from the annulus 127 without the fluids passing through the screen assembly 92. The tubular 140 forms an interior passageway 145 defined by an internal surface 150 of the tubular 140. One or more ports 155 extend between an external surface 160 of the tubular 140 and the internal surface 150. The port 155 is defined by a surface 165 that extends between the internal and external surfaces 150 and 160 of the tubular 140.

Generally, the ICD 90 is coupled to the external surface 160 of the tubular 140, directly or via another component. In some embodiments, the ICD 90 includes a housing 167 that has a fluid entrance 170 and a fluid exit 175. In other embodiments, the housing 167 is separate from the ICD 90 and a cover sleeve 168 connects the screen assembly 92 with the ICD 90. Regardless, the fluid exit 175 is formed through an external surface 180 of the housing 167 and/or the ICD 90 itself when the housing 167 is considered separate from the ICD 90. As illustrated the fluid exit 175 extends in a radial direction (relative to a longitudinal axis of the tubular 140), but in some embodiments the fluid exit 175 extends in a longitudinal direction or at any angle relative to the longitudinal axis of the tubular 140. Generally, the fluid entrance 170 is in fluid communication with the screen assembly 92 and receives filtered fluid from the screen assembly 92. In some embodiments, the ICD 90 distinguishes the types of downhole fluids flowing through the ICD 90 and allows wanted fluids to pass into the passageway 145 via the fluid exit 175 while restricting the flow of unwanted fluids into the passageway 145. The lower completion assembly 85 includes insert tabs 182 that are sized to fit within the ports 155 of the tubular 140. In some embodiments, the insert, or insert tab 182, at least partially extends within the port 155. In some embodiments, the tab 182 is fixed and sealed to the tubular 140 via a weld, a shrink fit, thermoplastic seal, etc. In some embodiments, each insert tab 182 includes or forms a passageway 185 aligned with, or at least adjacent to, the fluid exit 175 of the ICD 90. The lower completion assembly 85 has a first configuration and a second configuration. When in the first configuration and as illustrated in FIGS. 2 and 3, the lower completion assembly 85 includes a dissolvable plug 190 with the passageway 185. In some embodiments, an annular seal 195 extends between the plug 190 and a surface of the insert tab 182 that forms the passageway 185. In some embodiments, the annular seal 195 is an O-ring. In some embodiments, the annular seal 195 is an elastomeric seal, a metal sealing ring, a thermoplastic seal, etc. In some embodiments, the plug 190 includes a body in which an annular channel is formed to receive the annular seal 195. In some embodiments, the body of the plug 190 includes a flanged end that forms an annular shoulder that is sized to fit with a corresponding annular shoulder formed in the passageway 185. However, the body of the plug 190 and surface of the insert 182 may be threaded to form a threaded engagement of the plug 190 in the insert 182. Other types of engagement of the plug 190 and the insert 182 are considered here. When in the first configuration, the dissolvable plug 190 extends across the fluid exit 175 to fluidically isolate the fluid exit 175 from the interior passageway 145. When in the first configuration, the dissolvable plug 190 is configured to maintain a pressure within the interior passageway 145. In some embodiments, the pressure is greater than or equal to a pressure associated with setting a packer, such as the packer 110. Moreover, a gap 200 is defined adjacent the surface 165. In some embodiments and as illustrated in FIGS. 2 and 3, the gap 200 is an annular channel formed between the insert 182 and the surface 165 of the port 155. In some embodiments, the gap 200 extends from the internal surface 150 of the tubular 140 to the external surface 160 of the tubular 140.

Figure 4:
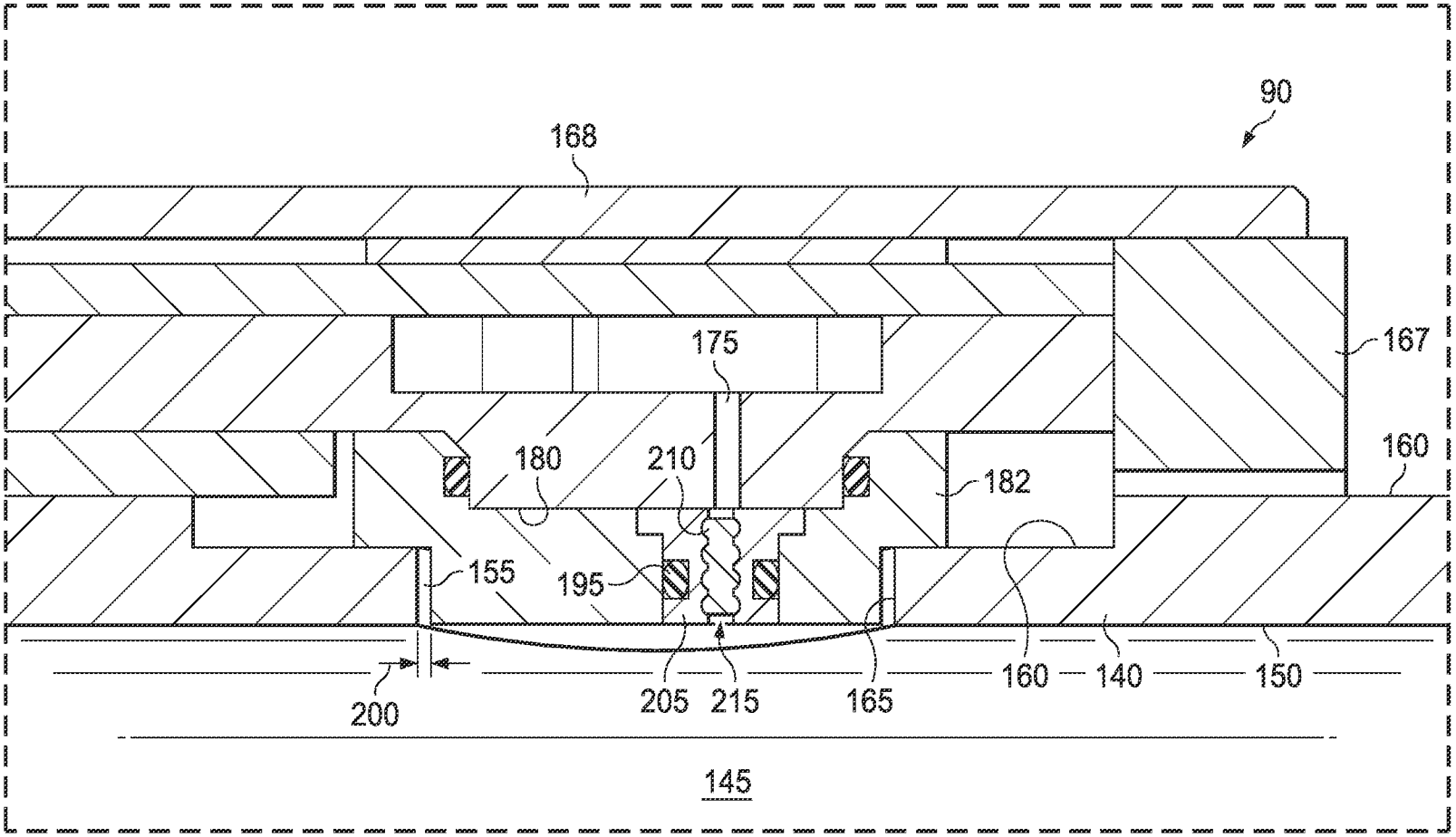
FIG. 4 illustrates an enlarged view of the ICD of FIG. 2 in a first configuration, according to another example embodiment of the present disclosure.

FIG. 4 illustrates another embodiment of the ICD 90 in which the plug 190 is omitted and a housing 205 and a plug 210 are within the passageway 185. In some embodiments, the housing 205 forms a passageway 215. In some embodiments and when the lower completion assembly 85 is the first configuration, the dissolvable plug 210 extends across the fluid exit 175 to fluidically isolate the fluid exit 175 from the interior passageway 145. In some embodiments and when the lower completion assembly 85 is in the first configuration, the dissolvable plug 210 is configured to maintain a pressure within the interior passageway 145. In some embodiments, the pressure is greater than or equal to a pressure associated with setting a packer, such as the packer 110. In some embodiments, the dissolvable plug 210 is press-fit into the passageway 215 to create a sealed surface. In some embodiments, the housing 205 has a similar shape to the plug 190. In some embodiments, the material forming the housing 205 is different from the material forming the plug 210, with the materials having different expansion rates. Thus, the housing 205 positions the plug 210 across the fluid exit 175 and allows for thermal expansion of the plug 210.

Figure 5:
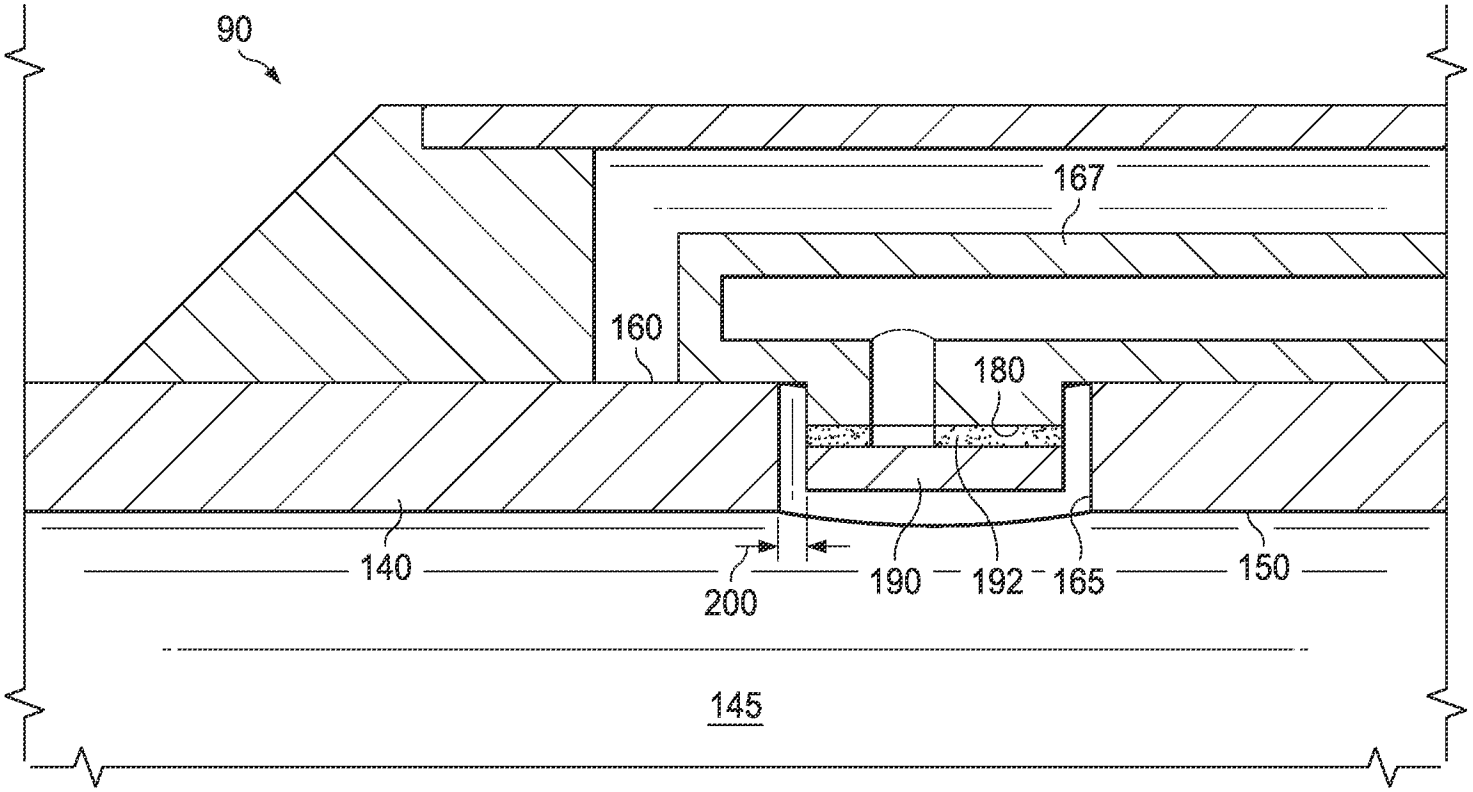
FIG. 5 illustrates a sectional view of the ICD of FIG. 1 in the first configuration, according to another example embodiment of the present disclosure.

FIG. 5 illustrates another embodiment of the ICD 90 in which the insert 182 is omitted and the plug 190 is bonded via bonding 192 to the surface 180 such that the plug 190 extends over the fluid exit 175 of the ICD 90. As such, the gap is defined by the surface 165 and an external surface of the plug 190. In some embodiments, the bonding 192 is an epoxy, a glue, a braze, or a soldering. In some embodiments, the plug 190 has a very high burst resistance, such as for example over 3,000 psi.

Generally, the ICD 90 of FIGS. 2-5, when in the first configuration, avoids any flow in/out through the ICD 90 and into the passageway 145.

In some embodiments, the plug 190 and/or 210 include or are formed from a metal, polymer, glassy materials (e.g., borate glass), and any combination thereof. Generally, the plug 190 and/or 210 are formed from materials that degrade in a wellbore fluid such as water, brine, or oil. In some embodiments, the plug 190 and/or 210 may be formed from a metal including aluminum alloys, magnesium alloys, and calcium alloys, for example. In some embodiments, the metal alloy is doped with iron, copper, nickel, tin, tungsten, or carbon in order to accelerate the galvanic corrosion. In some embodiments, the plug 190 and/or 210 are formed from a polymer that may include aliphatic polyester material, with a hydrolysable ester bond on the aliphatic polyester that makes it degrade in water. Examples include a poly (lactic acid) ("PLA") obtained from polycondensation of D- or L-lactic acid or from ring opening polymerization of lactide, which leads to semi-crystalline poly-L-lactide ("PLLA") and amorphous poly(L-lactide-co-D,L-lactide) ("PDLLA"). In some embodiments, a lower level of crystallinity is desired in order to promote degradation. Other examples include poly(glycolic acid) ("PGA"), poly(lactic-co-glycolic acid) ("PGLA"), Poly(caprolactone) ("PCL"), and Polyhydroxyalkonate. Other options of polymers include polyurethane, natural rubber, such as an epoxized natural rubber with 25% to 50 of the unsaturation in the rubber functionalized with epoxy groups, rubber modified polystyrene ("HIPS"), and acrylic rubber. The plug 190 and/or 210 can be strengthen by adding particles within a dissolvable metal matrix. In an example embodiment, this metal matrix composite is constructed from non-dissolving metal or non-dissolving ceramic. In an example embodiment, this non-dissolving particle is any shape including granules, rods, cones, acicular, et cetera. In an example embodiment, the ceramic granules are constructed from zirconia (including zircon), alumina (including fused alumina, chrome-alumina, and emery), carbide (including tungsten carbide, silicon carbide, titanium carbide, and boron carbide), boride (including boron nitride, osmium diboride, rhenium boride, and tungsten boride), nitride (including silica nitride), synthetic diamond, and silica. In an example embodiment, the ceramic is an oxide (like the alumina and zirconia) or a non-oxide (like the carbide, nitride, and boride). In an example embodiment, the ceramic granules have acute exterior angles to lock together.

Figure 6:
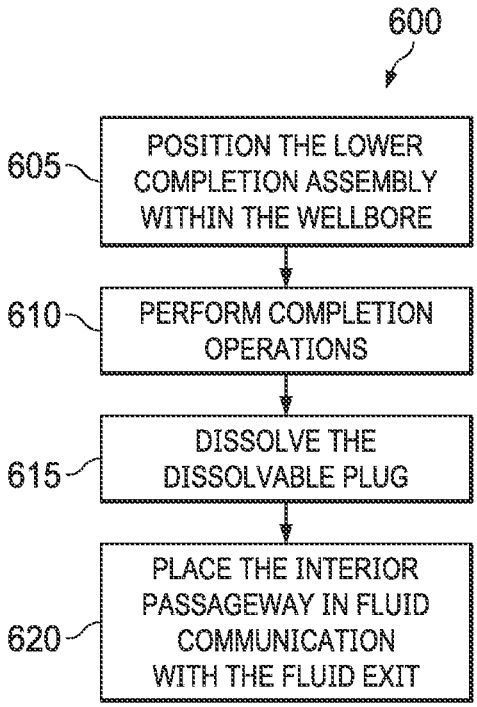
FIG. 6 is a flow chart illustration of a method of operating the apparatus of FIGS. 1-5, according to an example embodiment.

In an example embodiment, as illustrated in FIG. 6 with continuing reference to FIGS. 1-5, a method 600 of operating the ICD 90 includes positioning the lower completion assembly 85 within the wellbore 75 at step 605; performing completion operations at step 610; dissolving at least a portion of the plug 190 and/or 210 at step 615; and placing the interior passageway 145 in fluid communication with the fluid exit 175 of the ICD 90 at step 620.

At the step 605, the lower completion assembly 85 is positioned within the wellbore 75. Positioning the lower completion assembly 85 within the wellbore 75 defines the annulus 127.

At the step 610, completion operations are performed. For example, the passageway 145 is pressurized to a minimum pressure. Generally, pressurizing the passageway 145 to the minimum pressure includes pumping a mud or fluid down the tubing string 70 through the passageway 145. As the lower completion assembly 85 is in the first configuration and as the plug 190 is pressure rated to a pressure that is greater than the minimum pressure, the lower completion assembly 85 is configured to pressurize and maintain the passageway 145 to the minimum pressure. In some embodiments, the packer 110 is in fluid communication with the interior passageway 145, and pressurizing the passageway 145 to the minimum pressure results in setting the packer 110 relative the wellbore 75. Thus, the minimum pressure in some embodiments is greater than or equal to a pressure associated with setting the packer 110. In some embodiments, the step 610 may be omitted. In some embodiments and instead setting the packer 110, any number of other deployment or completion operations is completed.

Figure 7:
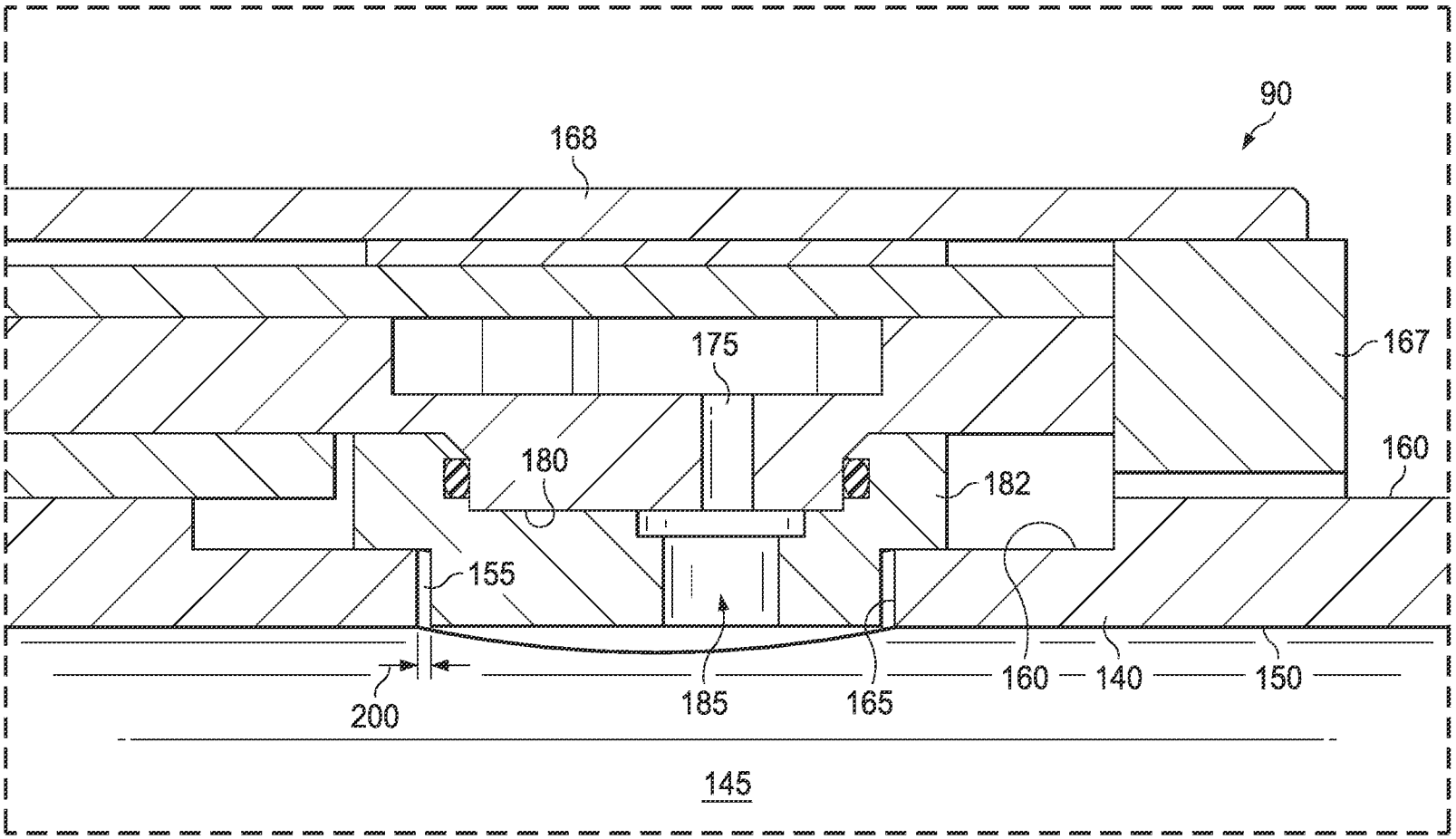
FIG. 7 illustrates the ICD of FIG. 3 in a second configuration, according to an example embodiment of the present disclosure.
Figure 8:
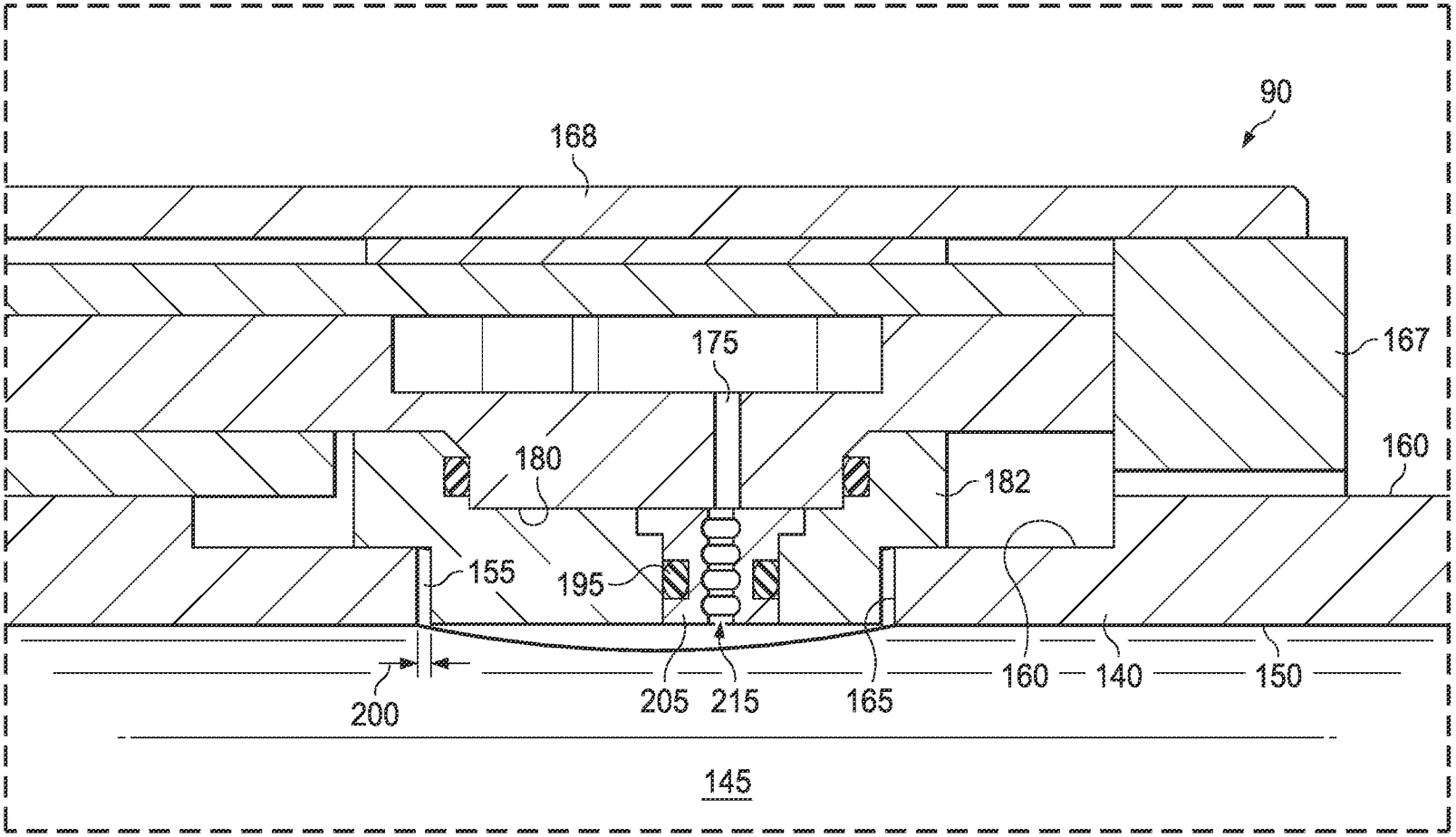
FIG. 8 illustrates the ICD of FIG. 4 in a second configuration, according to an example embodiment of the present disclosure.
Figure 9:
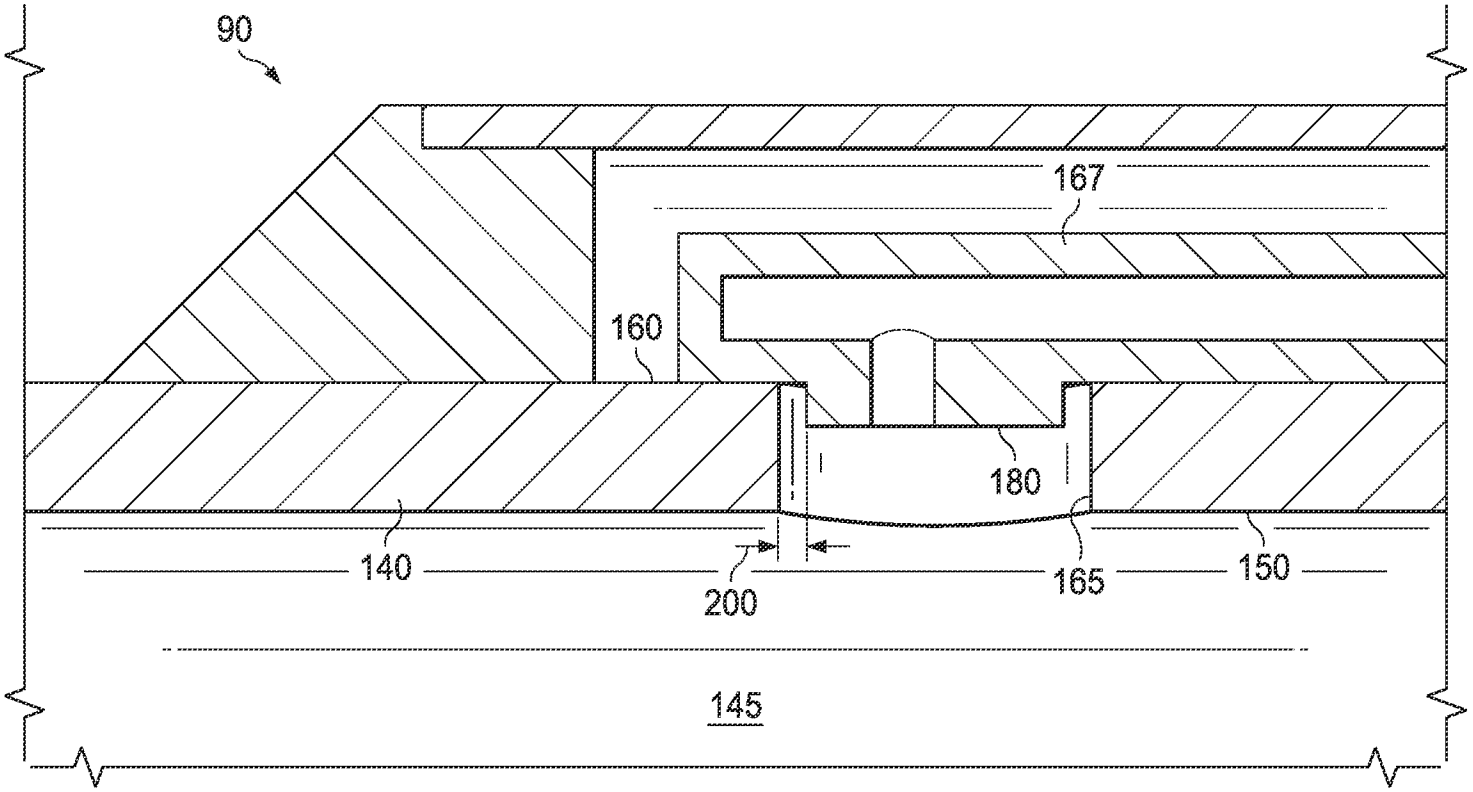
FIG. 9 illustrates the ICD of FIG. 5 in a second configuration, according to an example embodiment of the present disclosure.

At the step 615, at least a portion of the plug 190 is dissolved to place the lower completion assembly 85 in the second configuration as illustrated in FIGS. 7-9. As illustrated, the plug 190 and/or the plug 210 do not extend across the fluid exit 175. In some embodiments, dissolving the dissolvable plug 190 includes exposing the dissolvable plug 190 to a downhole or wellbore fluid. In an example embodiment, the wellbore fluid includes an organic or inorganic acid. In some embodiments, the wellbore fluid can include an acid with breakers, delayed release acid such as a lactic acid, a formic acid, a citric acid, and/or a hydrochloric acid. However, other methods of dissolving or breaking apart the plug 190 and/or the plug 210 are considered here, such as exposure to a specific temperature or change in temperature.

At the step 620, the interior passageway 145 is placed in fluid communication with the fluid exit 175. When the lower completion assembly 85 includes the insert 182, the fluid exit 175 is in fluid communication with the passageway 145 via the passageway 185 formed in the insert 182.

Any number of ports 155, fluid exits 175, and plugs 190 may be included, formed in, or coupled to, the tubular 140, which in some embodiments is a base pipe or any machined mandrel. Additionally, pressurizing the passageway 145 to the minimum pressure is not limited to activating the packers 110, 115, 120 and 125 and instead, may be used during fracturing operations, etc.

In one embodiment, the ICD 90 is an autonomous ICD that has fluidic components, such as a fluidic vortex, and/or moving parts such as a moving plate. Generally, the autonomous ICD 90 changes amount of fluid restriction when the properties of the fluid change. However, the ICD 90 in some embodiments is any type of ICD.

In an example embodiment, during the operation of the assembly 85 and/or the execution of the method 600, the ICD 90 can fluidically isolating the passageway 145 from the annulus 127 to: prevent accumulation of debris—from a circulation fluid, such as mud-within the ICD 90 during installation and positioning of the ICD 90 downhole; allow circulation without a wash pipe/string for circulation; delay or otherwise control the timing at which formation fluid begin to be received in the tubular 140; and/or allow for the passageway 145 to be pressurized and maintain the pressure for setting packers or fracturing. Specifically, as the lower completion assembly 85 is in the first configuration during deployment, the need to run a wash string is significantly reduced or eliminated. The elimination of the running of a wash string saves time and expense.

Thus, a lower completion assembly has been described. Embodiments of the lower completion assembly may generally include a tubular that includes an interior passageway defined by an internal surface of the tubular; and a port extending between an external surface of the tubular and the internal surface of the tubular; wherein the port is defined by a first surface that extends between the internal surface and the external surface; and an inflow control device that is coupled to the external surface of the tubular and that comprises a fluid exit that is adjacent the port; wherein the lower completion assembly has a first configuration and a second configuration; wherein, when in the first configuration: a dissolvable plug extends across the fluid exit to fluidically isolate the fluid exit from the interior passageway; and a gap is defined adjacent the first surface; and wherein, when in the second configuration, the dissolvable plug does not extend across the fluid exit and the fluid exit is in fluid communication with the interior passageway. Any of the foregoing embodiments may include any one of the following elements, alone or in combination with each other:

- When in the first configuration, the dissolvable plug is configured to maintain a pressure within the interior passageway.
- The pressure is greater than or equal to a pressure associated with setting a packer.
- Wherein when in the first configuration, the lower completion assembly further comprises an insert that at least partially extends within the port.
- The insert comprises a first passageway.
- The dissolvable plug extends within the first passageway of the insert.
- The gap is defined between an external surface of the insert and the first surface.
- When in the first configuration, the lower completion assembly further comprises a sealing element extending in the first passageway and between the insert and the dissolvable plug.
- When in the first configuration, the lower completion assembly further comprises a housing within the first passageway; wherein the housing has a second passageway; and wherein the dissolvable plug is within the second passageway.
- When in the first configuration, the dissolvable plug is bonded to the inflow control device.
- When in the first configuration, the gap is defined between an external surface of the dissolvable plug and the first surface.
- Wherein when in the first configuration, the gap is an annular channel.

When in the first configuration, the gap extends from the internal surface of the tubular to the external surface of the tubular.

Thus, a method has been described. Embodiments of the method may generally include positioning a lower completion assembly within a wellbore of a well to define an annulus between an external surface of the lower completion assembly and an internal surface of the wellbore, wherein the lower completion assembly comprises, when in a first configuration: a tubular comprising: an interior passageway defined by an internal surface of the tubular; and a port extending between an external surface of the tubular and the internal surface of the tubular; wherein the port is defined by a first surface that extends between the internal surface and the external surface; an inflow control device that is coupled to the external surface of the tubular and that comprises a fluid exit that is adjacent the port; and a dissolvable plug that extends across the fluid exit to fluidically isolate the fluid exit from the interior passageway; and wherein a gap is defined adjacent the first surface; and pressurizing, while the lower completion assembly is in the first configuration, the interior passageway of the tubular to a pressure; and dissolving the dissolvable plug to place the lower completion assembly into a second configuration and to place the annulus in fluid communication with the interior passageway. Any of the foregoing embodiments may include any one of the following elements, alone or in combination with each other:

The pressure is greater than or equal to a pressure associated with setting a packer.

When in the first configuration, the lower completion assembly further comprises an insert that at least partially extends within the port.

The insert comprises a first passageway.

The dissolvable plug extends within the first passageway of the insert.

The gap is defined between an external surface of the insert and the first surface.

When in the first configuration, the lower completion assembly further comprises a sealing element in the first passageway and between the insert and the dissolvable plug.

When in the first configuration, the lower completion assembly further comprises a housing within the first passageway; the housing includes a second passageway; and The dissolvable plug extends within the second passageway.

When in the first configuration, the dissolvable plug is bonded to the inflow control device.

Wherein when in the first configuration, the gap is defined between an external surface of the dissolvable plug and the first surface.

When in the first configuration, the gap is an annular channel.

When in the first configuration, the gap extends from the internal surface of the tubular to the external surface of the tubular.

Dissolving the dissolvable plug to place the annulus in fluid communication with the interior passageway comprises exposing the dissolvable plug to a downhole fluid.

The foregoing description and figures are not drawn to scale, but rather are illustrated to describe various embodiments of the present disclosure in simplistic form. Although various embodiments and methods have been shown and described, the disclosure is not limited to such embodiments and methods and will be understood to include all modifications and variations as would be apparent to one skilled in the art. Therefore, it should be understood that the disclosure is not intended to be limited to the particular forms disclosed. Accordingly, the intention is to cover all modifications, equivalents and alternatives falling within the spirit and scope of the disclosure as defined by the appended claims.

In several example embodiments, while different steps, processes, and procedures are described as appearing as distinct acts, one or more of the steps, one or more of the processes, and/or one or more of the procedures could also be performed in different orders, simultaneously and/or sequentially. In several example embodiments, the steps, processes and/or procedures could be merged into one or more steps, processes and/or procedures.

It is understood that variations may be made in the foregoing without departing from the scope of the disclosure. Furthermore, the elements and teachings of the various illustrative example embodiments may be combined in whole or in part in some or all of the illustrative example embodiments. In addition, one or more of the elements and teachings of the various illustrative example embodiments may be omitted, at least in part, and/or combined, at least in part, with one or more of the other elements and teachings of the various illustrative embodiments.

In several example embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Although several example embodiments have been described in detail above, the embodiments described are example only and are not limiting, and those skilled in the art will readily appreciate that many other modifications, changes and/or substitutions are possible in the example embodiments without materially departing from the novel teachings and advantages of the present disclosure. Accordingly, all such modifications, changes and/or substitutions are intended to be included within the scope of this disclosure as defined in the following claims. In the claims, means-plus-function clauses are intended to cover the structures described herein as performing the recited function and not only structural equivalents, but also equivalent structures.

Illustrative embodiments and related methods of the present disclosure are described below as they might be employed in a pressure actuated inflow control device. In the interest of clarity, not all features of an actual implementation or method are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure. Further aspects and advantages of the various embodiments and related methods of the disclosure will become apparent from consideration of the following description and drawings.

What is claimed is:

1. A lower completion assembly, comprising:

a tubular comprising:

an interior passageway defined by an internal surface of the tubular; and a port extending between an external surface of the tubular and the internal surface of the tubular;

wherein the port is defined by a first surface that extends between the internal surface and the external surface; and an inflow control device that is coupled to the external surface of the tubular and that comprises a fluid exit that is adjacent the port;

wherein the lower completion assembly has a first configuration and a second configuration;

wherein, when in the first configuration:

a dissolvable plug extends across the fluid exit to fluidically isolate the fluid exit from the interior passageway; and a gap is defined adjacent the first surface, the gap defined between an external surface of the dissolvable plug and the first surface; and wherein, when in the second configuration, the dissolvable plug does not extend across the fluid exit and the fluid exit is in fluid communication with the interior passageway; and wherein when in the first configuration, the dissolvable plug is bonded to the inflow control device.

2. A method, comprising:

positioning a lower completion assembly within a wellbore of a well to define an annulus between an external surface of the lower completion assembly and an internal surface of the wellbore, wherein the lower completion assembly comprises, when in a first configuration:

a tubular comprising:

an interior passageway defined by an internal surface of the tubular; and a port extending between an external surface of the tubular and the internal surface of the tubular;

wherein the port is defined by a first surface that extends between the internal surface and the external surface;

an inflow control device that is coupled to the external surface of the tubular and that comprises a fluid exit that is adjacent the port; and a dissolvable plug that extends across the fluid exit to fluidically isolate the fluid exit from the interior passageway; and wherein a gap is defined adjacent the first surface, the gap defined between an external surface of the dissolvable plug and the first surface; and pressurizing, while the lower completion assembly is in the first configuration, the interior passageway of the tubular to a pressure; and dissolving the dissolvable plug to place the lower completion assembly into a second configuration and to place the annulus in fluid communication with the interior passageway; and wherein when in the first configuration, the dissolvable plug is bonded to the inflow control device.

* * * * *